US005911454A

United States Patent [19]

Crothall

[11] Patent Number: 5,911,454

[45] Date of Patent: Jun. 15, 1999

[54] MICROSTRIP MANUFACTURING METHOD

[75] Inventor: George Crothall, Santa Clara, Calif.

[73] Assignee: Trimble Navigation Limited, Sunnyvale, Calif.

[21] Appl. No.: 08/954,439

[22] Filed: Oct. 20, 1997

Related U.S. Application Data

[62] Division of application No. 08/685,215, Jul. 23, 1996.

[51] Int. Cl.[6] ..... H01P 11/00

[52] U.S. Cl. ..... 29/600; 29/846

[58] Field of Search ..... 29/600, 832, 840, 29/852, 825

[56] References Cited

U.S. PATENT DOCUMENTS

| | | | |
|---|---|---|---|
| 3,350,250 | 10/1967 | Sanz et al. . | |
| 4,063,246 | 12/1977 | Greiser . | |
| 4,171,563 | 10/1979 | Withoos . | |
| 4,763,133 | 8/1988 | Takemura et al. . | |
| 4,889,584 | 12/1989 | Wada et al. . | |
| 4,987,425 | 1/1991 | Zahn et al. | 343/853 |
| 5,086,304 | 2/1992 | Collins . | |
| 5,315,753 | 5/1994 | Jensen et al. . | |
| 5,369,881 | 12/1994 | Inaba et al. | 29/846 |
| 5,495,262 | 2/1996 | Klebe . | |

FOREIGN PATENT DOCUMENTS

| | | | |
|---|---|---|---|
| 197805 | 4/1978 | France | 343/700 MS |

*Primary Examiner*—Carl J. Arbes
*Attorney, Agent, or Firm*—Wagner Murabito & Hao

[57] ABSTRACT

A parallel feed network antenna and a method for making a parallel feed network antenna having improved consistency in antenna pattern and improved reliability and which is easier and cheaper to manufacture is disclosed. In one embodiment of the present invention, a housing containing raised surfaces defining a channel is formed using plastic injection molding techniques. A layer of conductive material such as copper is selectively deposited over the surface of the housing so as to cover the channels. The upper surface of the housing is then removed until the conductive material which overlies the raised surfaces adjoining the channel is removed so as to form a microstrip. The patch antenna are then attached to the housing and electrically coupled to the microstrip to complete the antenna.

15 Claims, 6 Drawing Sheets

MICROSTRIP MANUFACTURING METHOD

This application is a divisional of U.S. application Ser. No. 08/685,215 filed Jul. 23, 1996 (pending).

TECHNICAL FIELD

The present claimed invention relates to the field of antenna devices and antenna device fabrication. More specifically, the present claimed invention relates to an improved parallel feed network and a method for manufacturing a parallel feed network antenna.

BACKGROUND ART

During prior art parallel feed network antenna manufacturing processes, conventional manufacturing tolerances cause the power level at antenna patches to be non uniform. This non uniformity results in the antenna feeding unequal amounts of energy to the patch antennas. Unequally feeding patch antennas results in a ripple in the antenna's overall pattern, thereby causing the performance of the antenna to be non uniform.

Conventional parallel feed network antenna contain numerous parts. Because of the high number of parts that must be manufactured and assembled, antenna manufacture is time consuming and costly.

A typical prior art parallel feed network antenna would include a flat dielectric controlled material such as a circuit board over which a strip of conductive material such as copper has been disposed. The reverse side of the dielectric is also covered with a conductive surface forming what is commonly known as a ground plane. The strip of copper is then either bonded, screwed, or clipped to the dielectric controlled material. The circuit board or dielectric controlled material would then be attached to a cylindrical housing. The attachment mechanism is typically a number of screws or clips. Patches are then attached to the endpoints of the copper strips using either screws or clips. Prior art processes commonly use flat surfaces for forming parallel feed circuits to assure that the resulting antenna will have a consistent relationship between the parallel feed network and the ground plane underneath the parallel feed network.

In conventional parallel feed network manufacturing processes, the parallel feed network is formed over the dielectric controlled material by placing a masking tool over the piece onto which parallel feed network is to be formed. Then, a catalyst is sprayed onto the piece. Next, the mask is removed and a layer of conductive material such as copper is applied over the piece to form a conductive path or strip. Often, the use of the mask to deposit conductive layer(s) onto the dielectric controlled material results in wicking under the edges of the mask and creeping of the deposited conductive material into crevices in the piece. Additional process steps such as trimming are often necessary to remove unwanted material and control the tolerance of the resulting part. However, the trimming process itself results in additional deviations from the desired dimensions.

Other methods include the use of etchbacks to define the conductive strips of the network as well as chemical etching and photo etch processes. However, each of the process steps of these prior art methods affects the tolerance of the part. Prior art methods typically achieve tolerances of between ±0.005 to ±0.010 inches.

In order to manufacture a parallel feed network antenna having a power output with a uniform pattern, it is critical that the amount of power reaching each patch antenna be equal. Since the power level is a function of the resistance of the conductive strip, and since the resistance of the conductive strip is a function of the length and width of the conductive strip, the tolerances of the manufacture of the copper strip determine whether an equal amount of power is received at each patch antenna.

Thus, the need has arisen for an improved antenna and a method for manufacturing an improved antenna which has improved uniformity of transmission and improved reliability. More specifically, there is need for a parallel feed network which has uniform strips of the parallel feed network and which has fewer parts and which is easier and cheaper to manufacture.

DISCLOSURE OF THE INVENTION

The present invention meets the above need with a parallel feed antenna which provides uniform power distribution and which is easy and inexpensive to manufacture and which is more durable and reliable than prior art antenna. The above achievement has been accomplished by using a molded housing including raised surfaces to define conductive channels of the parallel feed network.

Specifically, in one embodiment, a parallel feed antenna having a one-piece housing is disclosed. The housing has raised surfaces formed therein which define a number of channels that radiate from a single point to a number of endpoints equidistant from the single point. A layer of conductive material is deposited within the channels to provide an electrical pathway from the single point to each endpoint. Any portion of the deposited conductive layer which lies outside of the channel is easily removed from the top of the raised surfaces by milling, grinding, machining, or applying an abrasive material to the surface of the housing. The methods which are used to deposit the conductive layer into the channels include plating, chemical vapor deposition, direct application of the conductive layer, or the use of a mask to directly apply the conductive layer. However, any of a number of different methods may be used.

In a second embodiment, the step of removing the layer of conductive material is continued until a flat surface is achieved across the microstrip. This results in having a microstrip which has a flat top surface which is level with the tops of the raised surfaces directly adjoining the microstrip. Patch antennas are connected to the ends of the microstrip. Since the tolerance of the raised surfaces of the housing determine the tolerance of the microstrip, the tolerance associated with the resulting parallel feed network will be less than that of prior art processes and devices. Additionally, because the power transmitted by each of the antenna patches is a function of the resistivity of the microstrip, the reduction in the tolerance of the microstrip results in an antenna having uniform power at each patch antenna. Furthermore, because the parallel feed network is formed on the housing the number of parts required for manufacture has been greatly reduced which results in an antenna which is more durable and which is easier and cheaper to manufacture.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
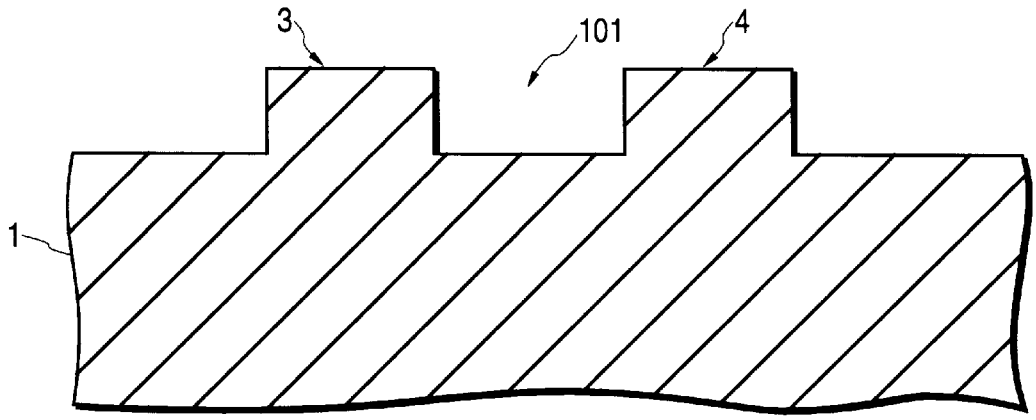
FIGS. 1–3 are cross sectional views illustrating the steps for manufacturing a parallel feed network antenna in accordance with the present claimed invention.
Figure 2:
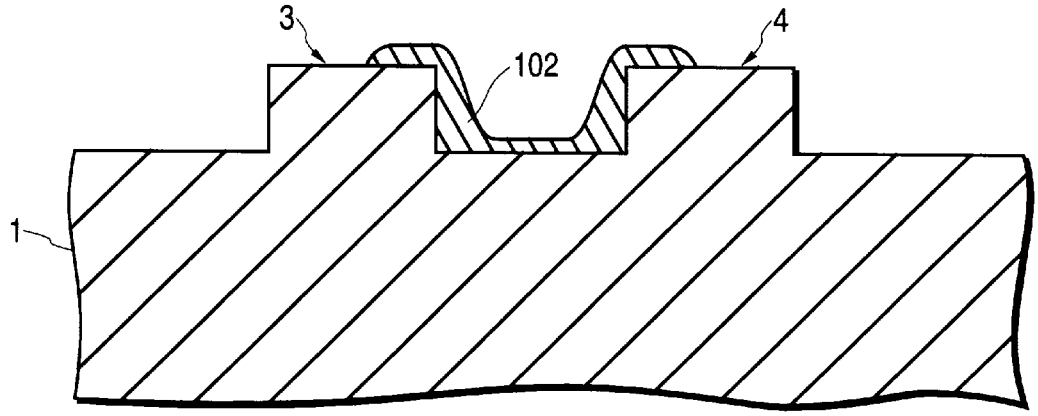
Figure 3:
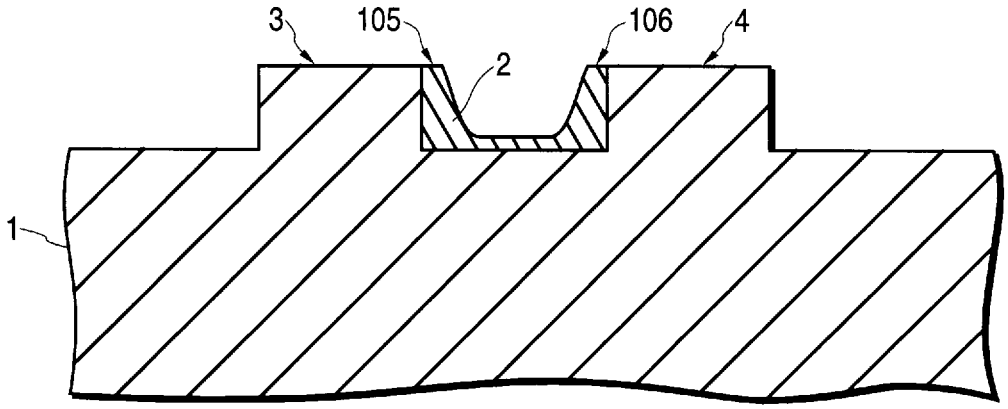

FIGS. 1–3 illustrate a method for forming a conductive microstrip in accordance with the present invention. FIG. 1 shows an enlarged cross sectional view of a portion of the top surface of the housing 1 along axis B—B of FIG. 7. Housing 1 is formed such that raised surface 3 and raised surface 4 define a channel 101. Housing 1 may be formed from any of a number of non conductive materials. However a plastic such as fenalloy which is a polycarbonate material is preferably used since, in combination with conductive strips having a larger width, it has the effect of averaging out the affects of the curvature of the feed network such that the antenna is not as susceptible to localized variance. The depth and width of the channel 101 are defined by raised surface 3 and raised surface 4. The housing 1, raised surface 3 and raised surface 4 are preferably formed by injection molding techniques. However, other processes which produce the required tolerances can be used. For example, machining, cutting or casting techniques can also be used. The tolerances for forming injection molded parts and for forming raised surfaces upon those parts allow for the size of the channel 101 to be controlled within a tolerance of two one thousandths (±0.002) of an inch. Thus, the present invention provides substantial improvement in tolerance control over prior art processes.

Next, a conductive layer is selectively deposited over the surface of housing 1. FIG. 2 illustrates the cross sectional view shown in FIG. 1 after conductive layer 102 has been selectively deposited over the surface of housing 1. In the present embodiment, copper is used as the conductive material. Conductive layer 102 can be formed from any of a number of conductive materials. The conductive layer 102 can be deposited by any of a number of methods well known in the art such as plating, chemical vapor deposition, masking and spraying or direct deposit methods. Conductive layer 102 is shown to partially overlie raised surface 3 and raised surface 4.

A surface removal step is then performed so that the portion of conductive layer 102 which overlies raised surface 3 and raised surface 4 is removed. The removal step may be performed by any of a number of processes will known in the art such as milling, cutting, grinding or abrading. However, preferably, the removal step is performed by grinding the top by moving a surface containing an abrasive material such as very fine grit paper over the surface of the housing such that it grinds the surface of the conductive layer. FIG. 3 shows an expanded cross sectional view of the housing after the surface removal step has been performed. The removal of that portion of the conductive layer overlying raised surface 3 and raised surface 4 defines microstrip 2. The width of the microstrip 2 at any point is defined by the width of the channel 101 formed by raised surface 3 and raised surface 4. Since the raised surface 3 and raised surface 4 are formed by processes allowing for close control of tolerances, a channel width having a tolerance of ±0.002 inches may be defined. Therefore, the microstrip which is formed will have a corresponding tolerance of two one thousandth (±0.002) inches. Any effects caused by the deposition of conductive material on the walls of the channel are minimized by reducing the height of raised surface 3 and raised surface 4 such that the height of the raised surface 3 and the raised surface 4 are only slightly higher than the intended thickness of the conductive layer 102.

Figure 4:
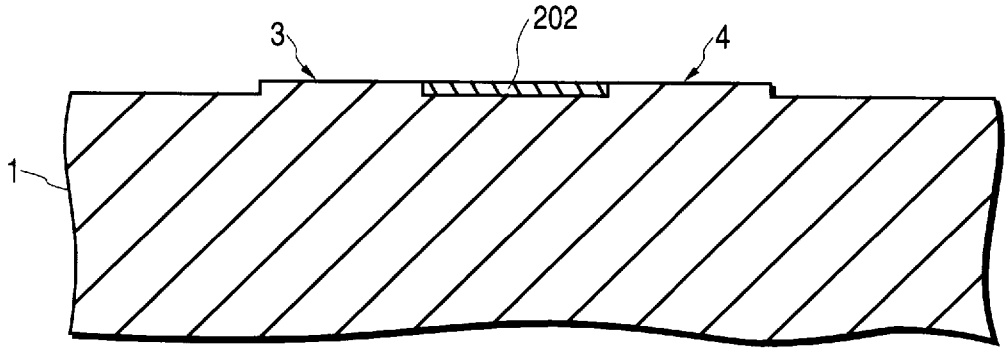
FIG. 4 is a cross sectional view of an alternate embodiment having a level top surface in accordance with the present invention.
Figure 6:
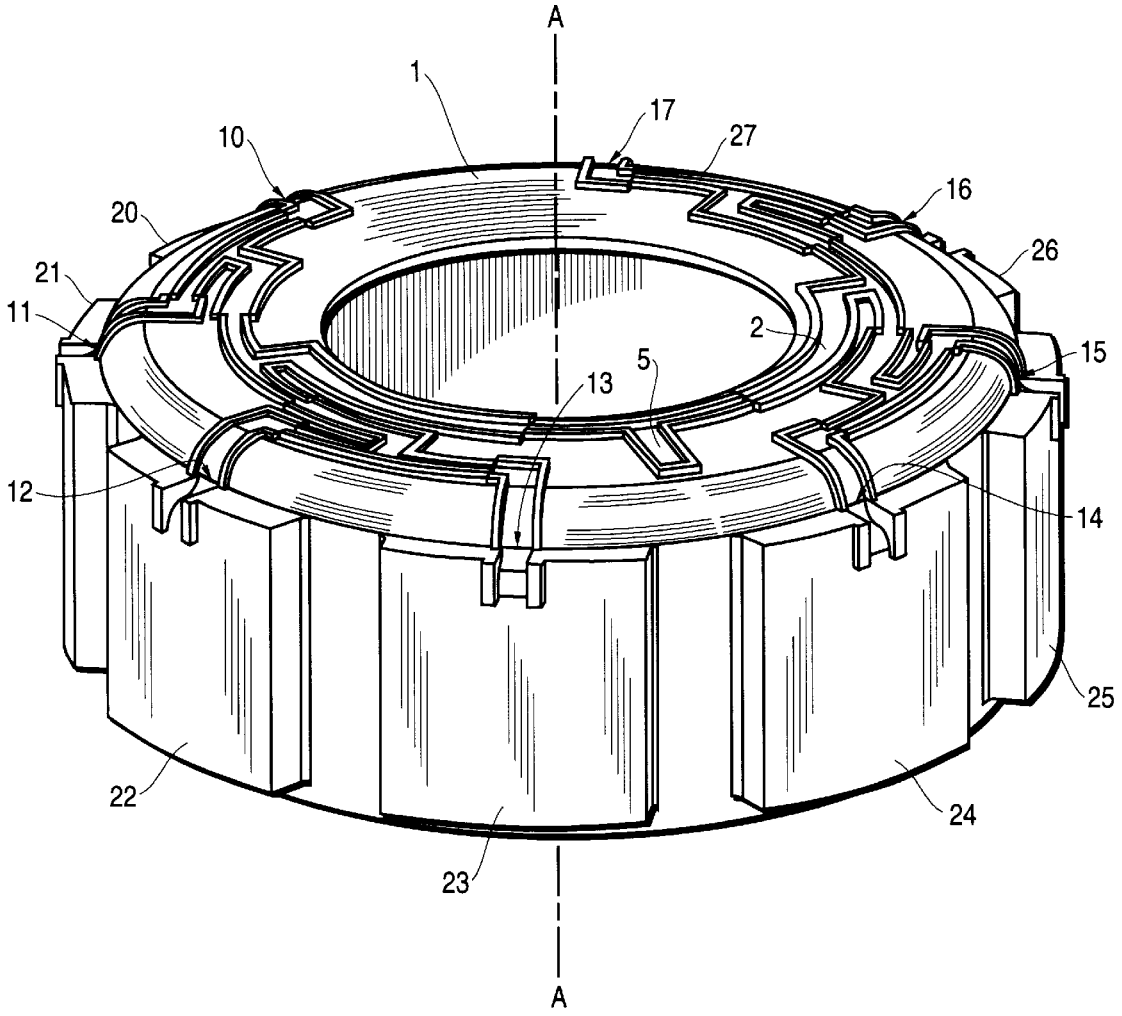
FIG. 6 is a perspective view illustrating an antenna having a parallel feed network formed over a housing in accordance with the present invention.
Figure 7:
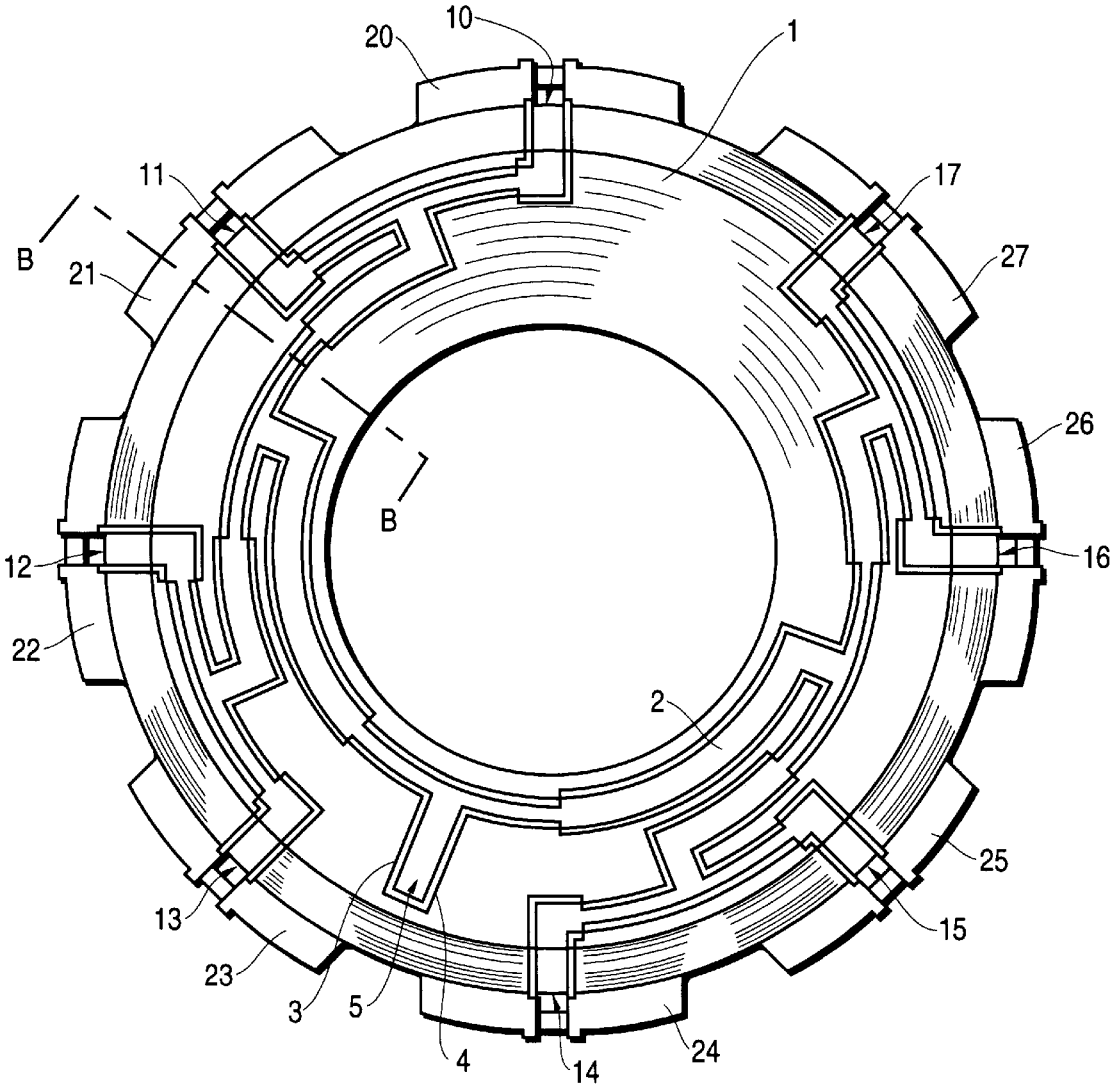
FIG. 7 is a top view of the parallel feed network antenna in accordance with the present claimed invention.

FIG. 4 is another embodiment of the present invention showing an enlarged cross sectional view of the housing 1 along axis B—B of FIG. 7. In this embodiment, the surface removal step is continued past the level illustrated in FIG. 6 and the surface is removed until the top surface the microstrip 202 is flat. The resulting surface will be level and flat from the top surface of raised surface 3, across the top surface of the microstrip 202 and across the top of raised surface 4. Portions of raised surface 3 and raised surface 4 will be removed. The resulting microstrip will not have any ridges such as ridge 105 and ridge 106 shown in FIG. 3. However, since the surface of the housing curves, the surface will only be level to the extent of the curvature of the housing at any particular point.

Figure 5:
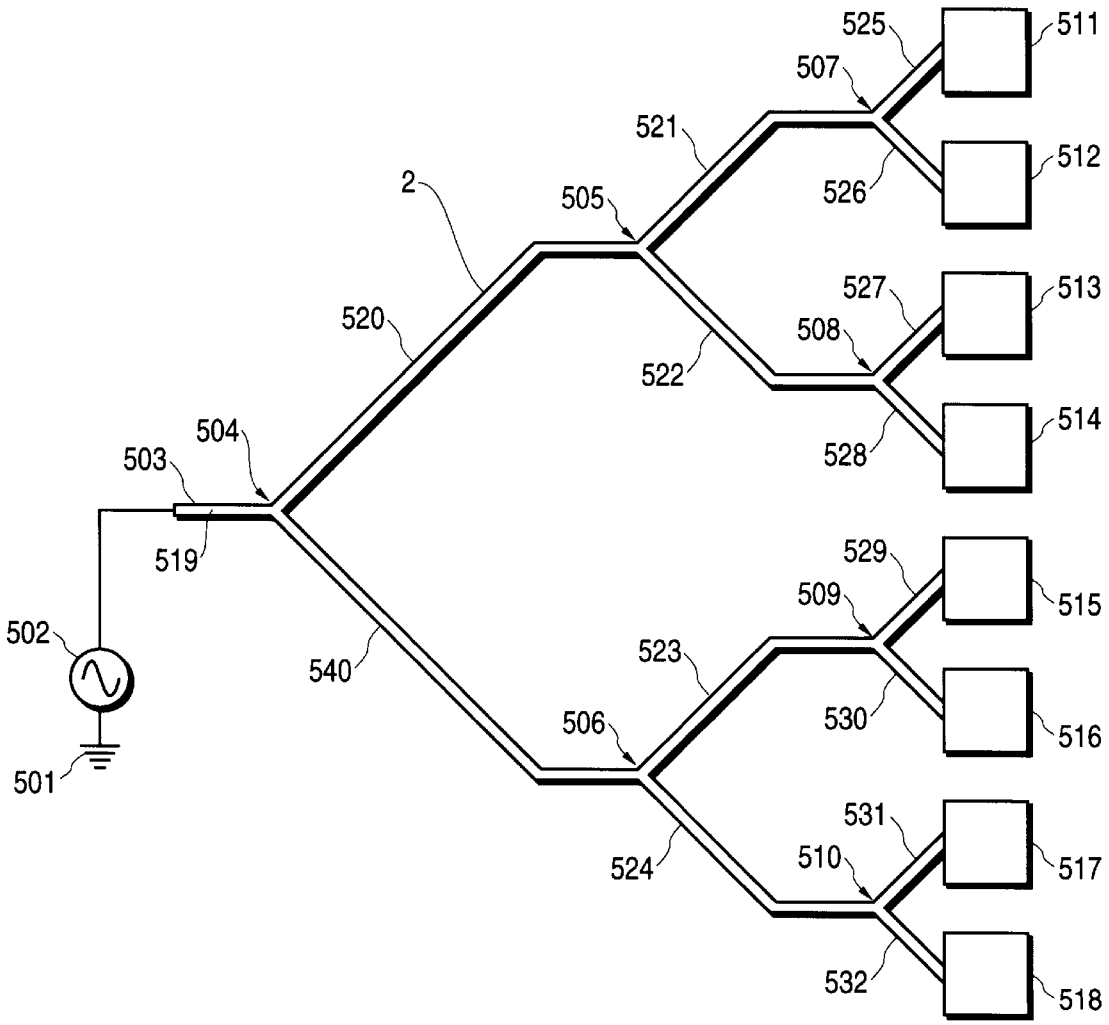
FIG. 5 is a diagram showing the circuit of the parallel feed network which illustrates the conductive segments of the microstrip in accordance with the present invention.

FIG. 5 shows a circuit diagram illustrating a parallel feed network including power source 502 which contacts ground 501 and which connects to microstrip 2 at power feed point 503 which is located on conductive segment 519. The microstrip 2 branches at branch 504 into two segments, conductive segment 520 and conductive segment 540. Conductive segment 520 branches at branch 505 into conductive segment 521 and conductive segment 522. Conductive segment 540 branches at branch 506 into conductive segment 523 and conductive segment 524. Conductive segment 521 branches at branch 507 into conductive segment 525 which contacts patch antenna 511 and branches to conductive segment 526 which contacts patch antenna 512. Conductive segment 522 branches at branch 508 into conductive segment 527 which contacts patch antenna 513 and branches to conductive segment 528 which contacts patch antenna 514. Conductive segment 523 branches at branch 509 into conductive segment 529 which contacts patch antenna 515 and branches to conductive segment 530 which contacts patch antenna 516. Conductive segment 524 branches at branch 510 into conductive segment 531 which contacts patch antenna 517 and branches to conductive segment 532 which contacts patch antenna 518. It can be seen that the network illustrated in FIG. 5 forms pathways of equal length from the power source 502 to each of the patch antennas 511–518.

With reference now to FIG. 6, a parallel feed network is shown which includes a housing 1. Housing 1 includes raised surfaces defining channels in which conductive microstrip 2 resides. Microstrip 2 radiates from power feed point 5 along segments which radiate radially along a series of expanding concentric circles to patch antenna connection points 10–17. Housing 1 has a top surface which curves from its inner circular edge toward an outer circular edge along a plane running through axis A—A. The network is designed so that the electrical pathways from power feed point 5 to each of the patch antenna connection points 10–17 are of equal length. The patch antenna connection points 10–17 are electrically connected to perspective patch antennas 20–27. When electrical current is applied to the power feed point 5, the current travels through microstrip 2 to each of patch antenna connection points 10–17 and to patch antennas 20–27. Each of antennas 21–27 then transmits power radially outward. By using a microstrip having reduced tolerances, a uniform amount of power is received at each of the patch antenna connection points 10–17. As a result the antenna generates a uniform transmission pattern.

As shown in FIG. 7, the top surface of the housing 1 has raised surfaces such as raised surface 3 and raised surface 4 which define channels. The channels formed by the raised surface 3 and the raised surface 4 contain conductive material, forming microstrip 2 which forms a series of conductive pathways from power feed point 5 to each of the patch antenna connection points 10–17. Patch antennas 20–27 are electrically connected to the ends of the microstrip 2 at repective patch antenna connection points 10–17. For example, patch antenna 20 is electrically connected to the microstrip 2 at patch antenna connection point 10, patch antenna 21 is electrically connected to the microstrip 2 at patch antenna connection point 11, and so on.

Figure 8:
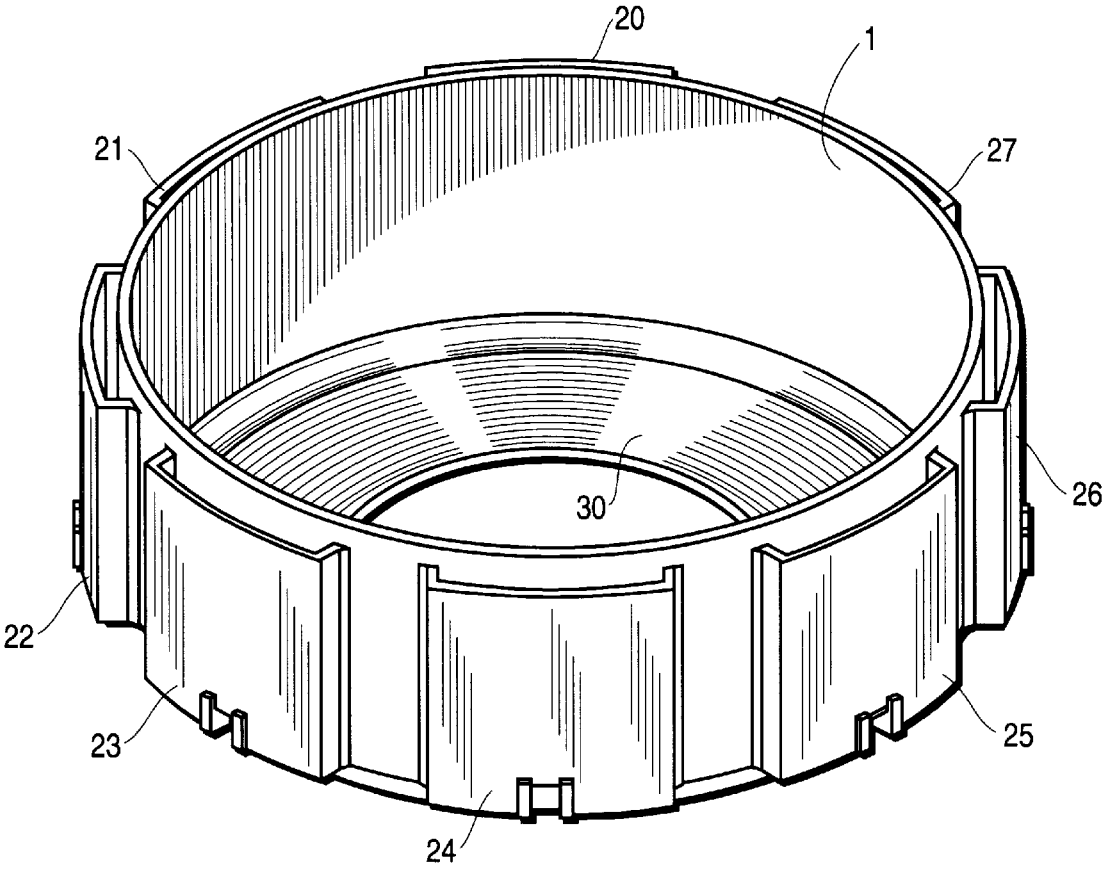
FIG. 8 is a bottom view of the housing for the parallel feed network in accordance with the present claimed invention.

FIG. 8 is a bottom view which shows how each of the patch antennas 20–27 are integrally formed within housing 1. Ground plane surface 30 is a conductive surface overlying housing 1. Methods for forming a ground plane are well known in the art. Preferably, the ground plane is formed by depositing a conductive layer directly over the surface of the housing 1. The ground plane is made of a conductive material such as copper.

The present invention is described with reference to a parallel feed network in which the network does not lie within the same horizontal plane. It has been found that the curvature of the feed network does not deleteriously affect the relationship between the parallel feed network and the ground plane as long as the microstrips are of a sufficient width. The relationship between the parallel feed network and the ground plane is maintained due to the fact that the radial symmetry of the curvature of the housing maintains the relationship between the feed network and the ground plane throughout the curvature of the microstrip.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

I claim:

1. A method for forming a strip of conductive material comprising the steps of:

forming a housing having a first raised portion and a second raised portion so as to define a channel, said first raised portion and said second raised portion extending from the top surface of said housing;

depositing a layer of conductive material over said housing such that said layer of conductive material is deposited within said channel and such that at least a portion of said layer of conductive material overlies said first raised portion and such that at least a portion of said layer of conductive material overlies said second raised portion; and removing some of said layer of conductive material such that said portion of said layer of conductive material that overlies said first raised portion is removed and such that said portion of said layer of conductive material that overlies said second raised portion is removed so as to form a strip of conductive material between said first raised portion and said second raised portion.

2. The method for forming a strip of conductive material as recited in claim 1 wherein said step of forming a housing having a first raised portion and a second raised portion is performed by using an injection molding process.

3. The method for forming a strip of conductive material as recited in claim 1 wherein said housing comprises plastic.

4. The method for forming a strip of conductive material as recited in claim 1 wherein said conductive material comprises a metal.

5. A method for forming a strip of conductive material comprising the steps of:

forming a housing having a first raised portion and a second raised portion so as to define a channel;

depositing a layer of conductive material over said housing such that said layer of conductive material is deposited within said channel and such that at least a portion of said layer of conductive material overlies said first raised portion and such that at least a portion of said layer of conductive material overlies said second raised portion; and moving a strip of abrasive material over the top surface of said layer of conductive material so as to remove some of said layer of conductive material such that said portion of said layer of conductive material that overlies said first raised portion is removed and such that said portion of said layer of conductive material that overlies said second raised portion is removed so as to form a strip of conductive material between said first raised portion and said second raised portion.

6. A method for forming a strip of conductive material comprising the steps of:

forming a housing having a first raised portion and a second raised portion so as to define a channel;

depositing a layer of conductive material over said housing such that said layer of conductive material is deposited within said channel and such that at least a portion of said layer of conductive material overlies said first raised portion and such that at least a portion of said layer of conductive material overlies said second raised portion; and removing some of said layer of conductive material so as to remove said portion of sand layer of conducted material that overlies said first raised portion and said portion of said layer of conductive material that overlies said second raised portion and at least some of said layer of conductive material deposited within said channel so as to form a strip of conductive material between said first raised portion and said second raised portion having a top surface and so as to form a top surface of said first raised surface and so as to form a top surface of said second raised surface such that at any one point along the length of said conductive material, said top surface of said strip of conductive material will lie within the same plane as said top surface of said first raised surface and said top surface of said second raised surface.

7. A method for making a parallel feed antenna comprising the steps of:

forming a housing having a plurality of raised surfaces such that said raised surfaces form a channel;

depositing a layer of conductive material within said channel such that a portion of said layer of conductive material overlies said plurality of raised surfaces;

removing some of said layer of conductive material such that said portion of said layer of conductive material that overlies said plurality of raised surfaces is removed so as to form a conductive strip; and attaching a patch antenna to said housing such that said patch antenna is electrically connected to said conductive strip.

8. The method of making a parallel feed antenna as recited in claim 7 wherein said housing is plastic and wherein said housing is formed by injection molding techniques.

9. The method for making a parallel feed antenna as recited in claim 8 wherein said step of depositing a layer of conductive material within said channel further includes the steps of:

masking said housing; and depositing a layer of conductive material over said housing.

10. The method for making a parallel feed antenna as recited in claim 7 wherein said conductive material comprises a metal and wherein said conductive strip includes a plurality of electrical pathways which electrically connect a power feed point to each of a plurality of patch antennas such that, upon the application of electrical current to said power feed point, said electrical current will travel along equidistant electrical pathways to each of said plurality of patch antennas so as to broadcast an equal amount of energy in each direction so as to achieve an output having a uniform pattern.

11. The method for making a parallel feed antenna as recited in claim 7 wherein said housing includes a patch antenna receptacle and wherein said step of attaching a patch antenna further includes the step of inserting said patch antenna into said patch antenna receptacle such that said patch antenna electrically contacts said conductive strip.

12. The method for making a parallel feed antenna as recited in claim 7 wherein said housing is formed around a central axis and wherein said housing has a top surface which has an inner circular edge and an outer circular edge and wherein said top surface of said housing is curved from its inner circular edge to its outer circular edge along a plane running through said central axis such that said conductive strip is curved from said inner circular edge to said outer circular edge of said housing.

13. A method for making a conductive surface on a dielectric material comprising the steps of:

forming a dielectric material having a plurality of raised surfaces that are integrally formed within said dielectric material such that said raised surfaces form a channel;

depositing a layer of conductive material within said channel such that a portion of said layer of conductive material overlies said plurality of raised surfaces; and removing some of said layer of conductive material such that said portion of said layer of conductive material that overlies said plurality of raised surfaces is removed so as to form a conductive strip having a constant height and a constant width.

14. The method for making a conductive surface of claim 13 wherein said dielectric material comprises plastic and wherein said step of forming a dielectric material includes the step of using an injection molding process.

15. The method for making a conductive surface of claim 14 wherein said layer of conductive material comprises copper.

* * * * *